US006538629B1

(12) United States Patent
Ito

(10) Patent No.: US 6,538,629 B1
(45) Date of Patent: Mar. 25, 2003

(54) LIQUID CRYSTAL DRIVER UNIT, LIQUID CRYSTAL DRIVING METHOD, AND LIQUID CRYSTAL DISPLAY DEVICE

(75) Inventor: Satoru Ito, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/486,860

(22) PCT Filed: May 7, 1999

(86) PCT No.: PCT/JP99/03643

§ 371 (c)(1),
(2), (4) Date: Apr. 5, 2001

(87) PCT Pub. No.: WO00/02185

PCT Pub. Date: Jan. 13, 2000

(30) Foreign Application Priority Data

Jul. 3, 1998 (JP) ..... 10-189425

(51) Int. Cl.[7] ..... G09G 3/36
(52) U.S. Cl. ..... 345/89; 345/94; 345/99
(58) Field of Search ..... 345/87, 89, 94, 345/95, 96, 99, 100, 208, 209

(56) References Cited

U.S. PATENT DOCUMENTS 5,206,635 A * 4/1993 Inuzuka et al. ..... 345/89

FOREIGN PATENT DOCUMENTS

| | | |
|---|---|---|
| JP | 6-347757 | 12/1994 |
| JP | 7-199863 | 8/1995 |
| JP | 8-241060 | 9/1996 |
| JP | 9-090914 | 4/1997 |
| JP | 11-249104 | 9/1999 |
| WO | WO 00/02185 | 1/2000 |

* cited by examiner

*Primary Examiner*—Regina Liang
(74) *Attorney, Agent, or Firm*—Hogan & Hartson, LLP

(57) ABSTRACT

A liquid crystal drive unit having a scanning electrode driver and a signal electrode driver and controlling display according to the multi-line selection method. Assuming that gray-scale display is achieved based on n-bit data, one horizontal period is divided into n selection periods whose temporal widths are weighted according to display data. The sequence in which the weighted selection periods are selected within one horizontal period is not fixed but may be varied. The sequence of the weighted selection periods is differentiated between adjoining liquid crystal driving electrodes in the signal electrode driver. Alternatively, the sequence of the weighted selection periods may be made identical between horizontal periods before and after a liquid crystal alternating signal changes. Moreover, the widths of the weighted selection periods within one horizontal period can be varied. Consequently, low power consumption is realized, gray-scale display can be achieved successfully without deterioration in contrast and occurrence of flickers or crosstalk.

30 Claims, 10 Drawing Sheets

DIRECTION OF SIGNAL LINE

| | $SEG_{4m+1}$ | $SEG_{4m+2}$ | $SEG_{4m+3}$ | $SEG_{4m+4}$ |
|---|---|---|---|---|
| 1 | a11(0,0) | a21(1,0) | a31(0,1) | a41(1,1) |
| 2 | a12(0,0) | a22(1,0) | a32(0,1) | a42(1,1) |
| 3 | a13(0,0) | a23(1,0) | a33(0,1) | a43(1,1) |
| 4 | a14(0,0) | a24(1,0) | a34(0,1) | a44(1,1) |
| 5 | b11(0,0) | b21(1,0) | b31(0,1) | b41(1,1) |
| 6 | b12(0,0) | b22(1,0) | b32(0,1) | b42(1,1) |
| 7 | b13(0,0) | b23(1,0) | b33(0,1) | b43(1,1) |
| 8 | b14(0,0) | b24(1,0) | b34(0,1) | b44(1,1) |
| 9 | c11(0,0) | c21(1,0) | c31(0,1) | c41(1,1) |
| 10 | c12(0,0) | c22(1,0) | c32(0,1) | c42(1,1) |
| 11 | c13(0,0) | c23(1,0) | c33(0,1) | c43(1,1) |
| 12 | c14(0,0) | c24(1,0) | c34(0,1) | c44(1,1) |
| 13 | d11(0,0) | d21(1,0) | d31(0,1) | d41(1,1) |
| 14 | d12(0,0) | d22(1,0) | d32(0,1) | d42(1,1) |
| 15 | d13(0,0) | d23(1,0) | d33(0,1) | d43(1,1) |
| 16 | d14(0,0) | d24(1,0) | d34(0,1) | d44(1,1) |

DIRECTION OF SCANNING LINE

FIG. 9(a)

| | $SEG_{4m+1}$ | $SEG_{4m+2}$ | $SEG_{4m+3}$ | $SEG_{4m+4}$ |
|---|---|---|---|---|
| 1H | a11,a12,a13,a14 | a21,a22,a23,a24 | a31,a32,a33,a34 | a41,a42,a43,a44 |
| 2H | b11,b12,b13,b14 | b21,b22,b23,b24 | b31,b32,b33,b34 | b41,b42,b43,b44 |
| 3H | c11,c12,c13,c14 | c21,c22,c23,c24 | c31,c32,c33,c34 | c41,c42,c43,c44 |
| 4H | d11,d12,d13,d14 | d21,d22,d23,d24 | d31,d32,d33,d34 | d41,d42,d43,d44 |

PAGE ADDRESS

FIG. 9(b)

WHEN LIQUID CRYSTAL ALTERNATING SIGNAL FR IS HIGH

| | SEG 4m+1 | SEG 4m+2 | SEG 4m+3 | SEG 4m+4 |
|---|---|---|---|---|
| | HIGH-ORDER LOW-ORDER | HIGH-ORDER LOW-ORDER | HIGH-ORDER LOW-ORDER | HIGH-ORDER LOW-ORDER |
| FIRST FIELD | (V2, V2) | (V2, −V2) | (−V2, V2) | (−V2, −V2) |
| SECOND FIELD | (V2, V2) | (V2, −V2) | (−V2, V2) | (−V2, −V2) |
| THIRD FIELD | (V2, V2) | (V2, −V2) | (−V2, V2) | (−V2, −V2) |
| FOURTH FIELD | (V2, V2) | (V2, −V2) | (−V2, V2) | (−V2, −V2) |

WHEN LIQUID CRYSTAL ALTERNATING SIGNAL FR IS LOW

| | SEG 4m+1 | SEG 4m+2 | SEG 4m+3 | SEG 4m+4 |
|---|---|---|---|---|
| | HIGH-ORDER LOW-ORDER | HIGH-ORDER LOW-ORDER | HIGH-ORDER LOW-ORDER | HIGH-ORDER LOW-ORDER |
| FIRST FIELD | (−V2, −V2) | (−V2, V2) | (V2, −V2) | (V2, V2) |
| SECOND FIELD | (−V2, −V2) | (−V2, V2) | (V2, −V2) | (V2, V2) |
| THIRD FIELD | (−V2, −V2) | (−V2, V2) | (V2, −V2) | (V2, V2) |
| FOURTH FIELD | (−V2, −V2) | (−V2, V2) | (V2, −V2) | (V2, V2) |

FIG. 10

LIQUID CRYSTAL DRIVER UNIT, LIQUID CRYSTAL DRIVING METHOD, AND LIQUID CRYSTAL DISPLAY DEVICE

BACKGROUND OF THE INVENTION

1. Field of the Invention

The present invention relates to a liquid crystal drive unit, a liquid crystal driving method, and a liquid crystal display device. More particularly, this invention is concerned with a liquid crystal drive unit, a liquid crystal driving method, and a liquid crystal display device capable of successfully achieving gray-scale display without deterioration in contrast or occurrence of flickers or crosstalk.

2. Related Art

Liquid crystal display devices have been applied to various fields in recent years. Examples of the application fields include the fields of relatively inexpensive information apparatuses such as personal digital assistants (PDA) and portable telephones, of portable game machines, and of home electric appliances. Many pieces of equipment having the liquid crystal display devices are intended to be portable. Along with a request for an apparatus usable for a long period of time without the necessity of recharge, a liquid crystal display device requiring low power consumption is on demand.

Conventional methods for realizing gray-scale display include a frame rate control method (FRC), a pulse width modulation method (PWM), and a pulse height modulation method (PHM). The frame rate control method is such that a plurality of frames of gray-scale data, which has been thinned, is used to display data with a gray scale. The pulse width modulation method is such that gray-scale data is weighted according to the widths of selection periods in order to achieve gray-scale display. The pulse height modulation method is such that gray-scale data is weighted according to applied voltages in order to achieve gray-scale display.

Among these methods, the FRC and PHM methods are implemented in display systems using an active matrix type liquid crystal display panel for display, and can achieve gray-scale display successfully. However, the circuitry of a signal line driver is likely to be complex and to be scaled up.

In contrast, the PWM method is utilized as one of gray-scale display methods to be implemented mainly in display systems having a passive matrix type liquid crystal display panel used for display. The gray-scale display method of the PWM method is adopted together with a method for achieving liquid crystal display according to a multi-line selection driving method (MLS, Japanese Unexamined Patent Publication No. 9-281463) to be described later, whereby effective gray-scale display can be achieved with excellent contrast ensured.

The conventional PWM gray-scale method based on the MLS driving method will be described in conjunction with the drawings.

FIG. 6 shows driving waves employed in displaying gray-scale display data shown in FIG. 9 using a four-level gray scale according to the PWM method. FIG. 10 shows the results of the arithmetic operations for MLS performed on gray-scale display data shown in FIG. 9 in relation to fields. Referring to FIG. 6, one horizontal period is divided in the ratio of 1:2. Assume that the short period is a period F and the long period is a period S. SEG4m+1 denotes a driving wave used to express gray-scale level 0, SEG4m+2 denotes a driving wave used to express gray-scale level 2, SEG4m+3 denotes a driving wave used to express gray-scale level 1, and SEG4m+4 denotes a driving wave used to express gray-scale level 3. SEG4m+1 that is used to express gray-scale level 0 represents a liquid crystal driving potential V2, which results from the arithmetic operations for MLS performed on the high-order and low-order display data items, during both the selection periods F and S. Likewise, SEG4m+4 that is used to express gray-scale level 3 represents a liquid crystal driving potential −V2, which results from the arithmetic operations for MLS performed on the high-order and low-order display data items, during both the selection periods F and S. SEG4m+2 that is used to express gray-scale level 2 represents the potential −V2, which results from the arithmetic operations for MLS performed on the low-order display data, during the selection period F. The SEG4m+2 represents the potential V2, which results from the arithmetic operations for MLS performed on the high-order display data, during the selection period S. SEG4m+2 that is used to express gray-scale level 1 represents the potential V2, results from the arithmetic operations for MLS performed on the low-order display data, during the selection period F. The SEG4m+3 represents the potential −V2, which results from the arithmetic operations for MLS performed on the high-order display data, during the selection period S.

However, the conventional PWM method has a problem with deterioration in display definition stemming from crosstalk or the like. The crosstalk is derived from differences among the frequency components of signal line driving waves associated with gray-scale levels, smoothing of signal electrode waves, or influence of signal electrode signals on the potentials at other liquid crystal elements via a scanning electrode. In short, the cause of the crosstalk is mainly a change in an applied voltage derived from the fact that the frequency of a driving voltage wave differs with a display pattern and that the drive voltage wave distorts at transparent electrodes.

SUMMARY OF THE INVENTION

In consideration of the foregoing problem, an object of an embodiment of the present invention is to provide a PWM type liquid crystal drive and driving method. Herein, the way of handling display data used to achieve gray-scale display and the gray-scale display control sequence are improved in order to realize low power consumption and a simpler configuration.

Another object of the embodiment of the present invention is to provide a liquid crystal display device having a relatively simple configuration, requiring low power consumption, and capable of successfully achieving gray-scale display without deterioration in contrast and occurrence of flickers or crosstalk.

The present inventors had a profound discussion in efforts to accomplish the above objects. Accordingly, it is still another object of the embodiment of the present invention to simplify the frequency components by varying the sequence in which data items are selected for each horizontal period without fixing the sequence.

The present invention has its aspects related to the following forms:

(Liquid Crystal Driver)

In accordance with the first aspect of one embodiment of the present invention, a liquid crystal drive unit has a scanning electrode driver, a signal electrode driver, a frame memory incorporated in the signal electrode driver for storing display data, and a gray-scale display unit incorporated therein. The liquid crystal drive unit controls display according to the multi-line selection driving method. The gray-scale display unit achieves gray-scale display using n-bit data (where n denotes a natural number, or preferably a natural number ranging from 1 to 4, or more preferably 2 or 3). One horizontal period is divided into n selection periods whose temporal widths are weighted in association with display data.

The signal electrode driver has a controller for varying the sequence in which the plurality of differently weighted selection periods is selected for each horizontal period.

In the liquid crystal drive unit according to the embodiment of the present invention, the sequence in which the plurality of differently weighted selection periods is selected may be differentiated between a first liquid crystal electrode and a second liquid crystal electrode which are mutually adjoining in the signal electrode driver.

In another embodiment of the present invention, the sequence in which the plurality of differently weighted selection periods is selected may be identical between one horizontal period within which a liquid crystal alternating signal changes and another horizontal period immediately succeeding the one horizontal period.

Moreover, in the liquid crystal drive unit according to another embodiment of the present invention, the temporal widths of the weighted selection periods are preferably variable.

(Liquid Crystal Driving Method)

According to the second aspects of the embodiment of the present invention, there is provided a liquid crystal driving method for displaying display data using a liquid crystal according to the multi-line selection driving method. In one embodiment, assuming that gray-scale display is achieved based on n-bit data (where n denotes a natural number), one horizontal period is divided into n selection periods whose temporal widths are weighted differently according to the display data. The sequence in which the plurality of differently weighted selection periods is selected is varied for each horizontal period.

In the liquid crystal driving method according to the embodiment of the present invention, the timing when a liquid crystal driving voltage makes a transition is preferably changed between successive outputs of a signal electrode driver.

In the liquid crystal driving method according to the embodiment of the present invention, the timing when the liquid crystal driving voltage makes a transition is preferably not fixed but varied for each horizontal period.

Furthermore, in the liquid crystal driving method according to the embodiment of the present invention, the liquid crystal driving voltage is preferably caused to make a transition when one horizontal period within which a liquid crystal alternating signal changes shifts to an immediately succeeding horizontal period.

Furthermore, in the liquid crystal driving method according to embodiment of the present invention, the timing when the liquid crystal driving voltage makes a transition may preferably be identical between the horizontal period within which the liquid crystal alternating signal changes and a horizontal period immediately succeeding the horizontal period.

(Liquid Crystal Display Device)

The present invention also relates to a liquid crystal display device having the liquid crystal drive unit provided according to the first aspect of the embodiment of the present invention.

The liquid crystal display device in accordance with the embodiment of the present invention can successfully achieve gray-scale display without deterioration in contrast and occurrence of flickers or crosstalk while resolving the drawbacks that underlie the conventional PWM system and realizing low power consumption.

(Electronic Apparatus Having the Liquid Crystal Display Device)

The liquid crystal display device in accordance with the embodiment of the present invention is preferably adapted to electronic apparatuses including information apparatuses such as PDAs and portable telephones, portable game machines, and home electric appliances.

BRIEF DESCRIPTION OF THE DRAWINGS

FIG. 9A is a schematic explanatory diagram showing addresses in a display space in a liquid crystal display panel for four-level gray-scale display;

FIG. 9B is a schematic explanatory diagram showing pixel addresses in a RAM in a signal line drive IC; and FIG. 10 shows the results of the arithmetic operations for MLS performed on display data shown in FIG. 9.

EMBODIMENTS OF THE INVENTION IN THE BEST MODE (Liquid Crystal Drive Unit)

A liquid crystal drive unit in accordance with one embodiment of the present invention is mainly formed from a scanning electrode driver, a signal electrode driver, a frame memory incorporated in the signal electrode driver and used to store display data, and a gray-scale display unit incorporated therein.

The scanning electrode driver has the ability to apply a required voltage to a scanning electrode in the gray-scale display unit. The scanning electrode driver is realized as, for example, a scanning electrode drive circuit. The signal electrode driver is mainly formed from the frame memory that is used to store display data, the gray-scale display unit, a plurality of liquid crystal driving electrodes, and a controller. The gray-scale display unit is, for example, a gray-scale display panel such as a liquid crystal panel. The controller varies the sequence of weights to be selected for one horizontal period.

Figure 1:
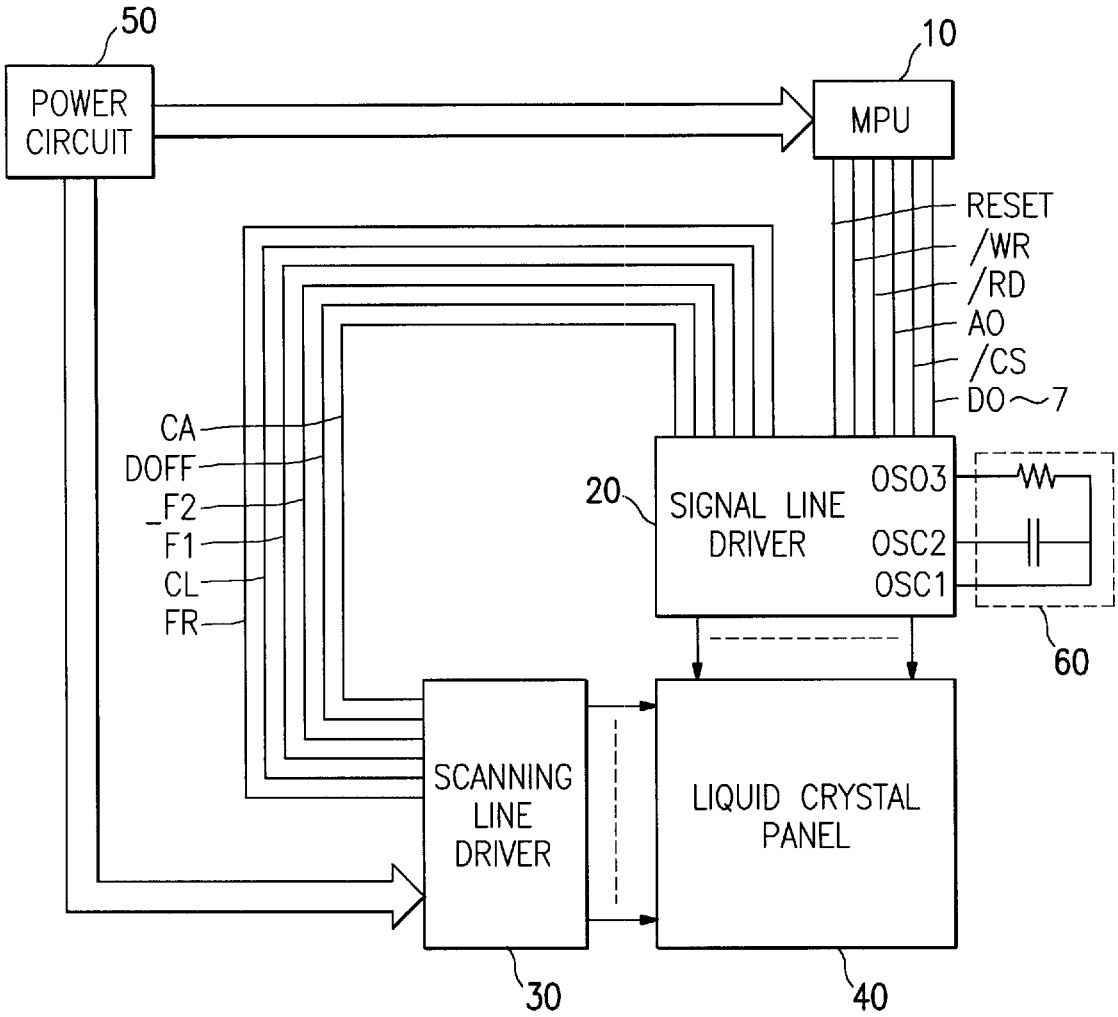
FIG. 1 is a block diagram showing a liquid crystal display device in which the present invention is implemented.

Display data and control signals (data transferred from an MPU 10 in FIG. 1) are transferred to the signal electrode driver (signal line driver 20 in FIG. 1). The transferred display data and control signals are used to perform the arithmetic operations for MLS, whereby a liquid crystal driving potential is determined. After the liquid crystal driving potential is thus determined, the signal electrode driver transfers the control signals to the scanning electrode driver and the liquid crystal driving potential to the gray-scale display panel at the same time.

The scanning electrode driver in turn determines a liquid crystal driving potential according to the control signals transferred from the signal electrode driver.

Based on the liquid crystal driving potentials thus determined by the signal electrode driver and the scanning electrode driver, display data is displayed on the gray-scale display panel.

Figure 5:
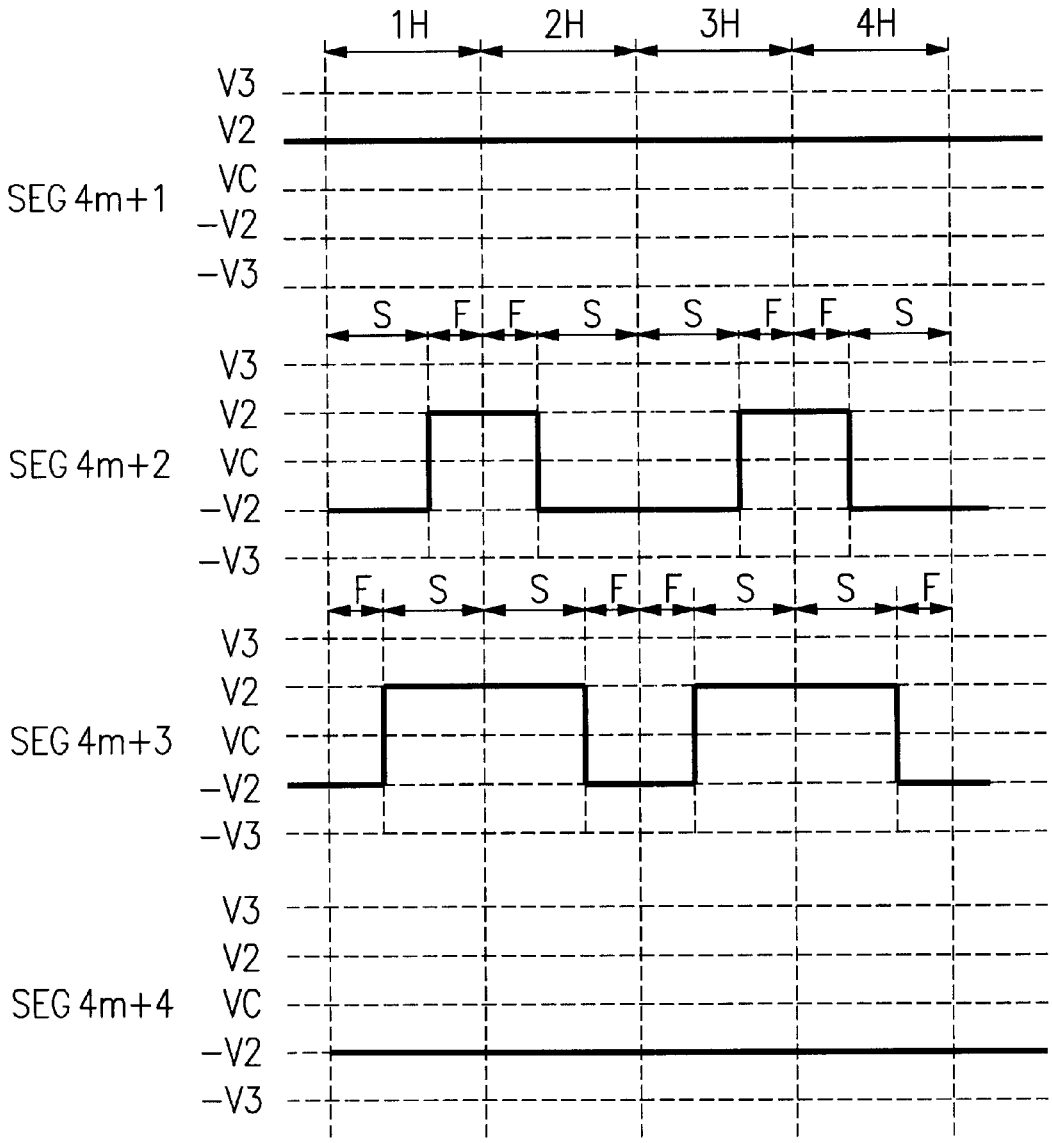
FIG. 5 shows driving waves produced by the signal line driver according to the PWM method and the multi-line selection method related to the present invention.
Figure 6:
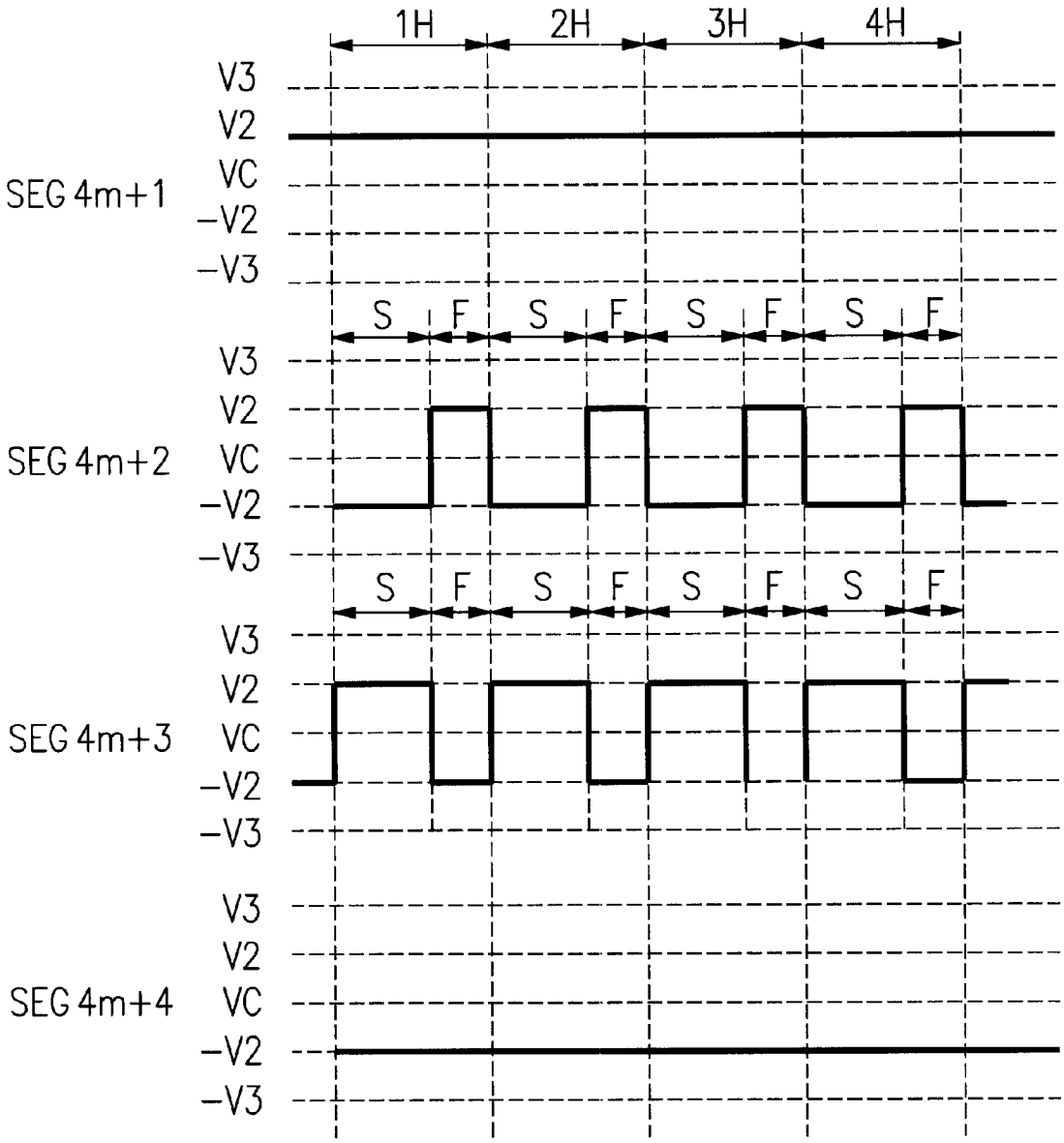
FIG. 6 PRIOR ART
FIG. 6 shows the driving waves produced by the signal line driver according to the PWM method and the multi-line selection method related to a prior art.

According to a liquid crystal driving method based on the conventional MLS driving method, the sequence of weights to be selected for each horizontal period is fixed (see FIG. 6). In contrast, in accordance with one embodiment of the present invention, the sequence of weights to be selected for each horizontal period may be varied for each horizontal period. In the liquid crystal drive unit in accordance with one embodiment of the present invention, the signal electrode driver has a controller that is realized as, for example, a control circuit (e.g., LCD control circuit 130 in FIG. 2). The controller varies the sequence in which a plurality of differently weighted selection periods is selected for each horizontal period, as shown in FIG. 5. The controller thus optimizes the sequence of weights for each horizontal period.

Incidentally, what is stated as "the sequence in which a plurality of differently weighted selection periods is selected is varied for each horizontal period" in the description of the present invention means that the sequence of periods F and S within one horizontal period can be switched arbitrarily. This makes it possible to vary a pulse duration so as to decrease the number of frequency components.

Moreover, the number of bits constituting display data, n, and the number of selection periods within one horizontal period, n, are equal to each other. For example, when data is displayed with a four-level gray scale, all the gray-scale levels can be expressed with two bits. One horizontal period is halved. When data is displayed with an eight-level gray scale, all the gray-scale levels can be expressed with 3 bits. One horizontal period is trisected. The temporal widths of divisions or selection periods are weighted and thus determined.

The sequence of weights to be selected for each horizontal period is optimized as described below. Namely, the sequence in which a plurality of differently weighted selection periods is selected is differentiated between a first liquid crystal driving electrode and a second liquid crystal driving electrode that are mutually adjoining in the signal electrode driver.

In one embodiment, selection periods during which high-order display data and low-order display data of gray-scale display data are selected respectively will be alternated for each horizontal period. In one embodiment, the gray-scale display data renders, as shown in FIG. 5, four lines. Consequently, the number of transitions made by a liquid crystal driving wave becomes smaller than that thought to be made conventionally. This results in a smaller difference between the number of frequency components of a driving wave that is used to express gray-scale level 0 (solid white) or gray-scale level 3 (solid black) and the number of frequency components of a driving wave that is used to express gray-scale level 1 or 2 (intermediate gray-scale level). In the embodiment described above, four lines are selected at a time. It is noted that the same effects can be obtained when L lines (L is a positive integer) are selected at a time.

The sequence in which a plurality of differently weighted selection periods is selected is made identical between one horizontal period within which a liquid crystal alternating signal changes and another horizontal period immediately succeeding the horizontal period. In one embodiment, the timing when a liquid crystal driving wave makes a transition is differentiated between each odd-numbered output and even-numbered output of the signal line driver. Consequently, the number of signal lines on which the liquid crystal driving waves make a transition at the same time is halved. This leads to reduced influence of motion of charges transmitted over a common scanning electrode.

What is referred to as a liquid crystal alternating signal is a signal for cyclically reversing the polarity of a liquid crystal driving wave so as to prevent so-called sticking of pixels appearing on the liquid crystal panel. The polarity is reversed once per to twenty horizontal (1H) periods.

Furthermore, when the widths of the weighted selection periods within one horizontal period are variable, shades of intermediate gray-scale levels can be adjusted easily. Consequently, shades can be adjusted in line with the characteristics of a liquid crystal panel employed.

(Liquid Crystal Driving Method)

The second aspect of the embodiment of the present invention relates to a liquid crystal driving method for displaying display data using a liquid crystal according to the multi-line selection driving method. Specifically, assuming that gray-scale display is achieved based on n-bit data (where n denotes a natural number), one horizontal period is divided into n selection periods whose temporal widths are weighted according to the display data.

The liquid crystal driving method is characterized in that the sequence in which the plurality of differently weighted selection periods is selected is varied for each horizontal period.

Since the sequence in which the plurality of differently weighted selection periods is selected is varied for each horizontal period, low power consumption is realized, and gray-scale display can be achieved successfully without deterioration in contrast and occurrence of flickers or crosstalk.

In the liquid crystal driving method according to the second aspect of the embodiment of the present invention, a liquid crystal display mechanism is identical to that described in relation to the first aspect thereof. The description of the liquid crystal display mechanism will therefore be omitted.

According to the second aspect of the embodiment of present invention, the sequence in which the plurality of differently weighted selection periods is selected is varied as described below. Specifically, the timing when a liquid crystal driving wave makes a transition is differentiated between successive outputs of a signal electrode driver. The sequence in which the plurality of differently weighted selection periods is selected is differentiated between adjoining signal electrodes to be driven by the signal electrode driver. Consequently, as mentioned in relation to the first aspect, the number of transitions made by the liquid crystal driving wave becomes smaller than the number of transitions that was thought to be made conventionally. This leads to a smaller difference between the number of frequency components of a driving wave used to express a gray-scale level and that of a driving wave used to express another gray-scale level.

Moreover, according to the method of the embodiment of the present invention, the timing when the liquid crystal driving wave makes a transition may not be fixed but varied for each horizontal period. In this case, shades of intermediate gray-scale levels can be adjusted easily.

Moreover, according to the method of the embodiment of the present invention, the timing when the liquid crystal driving wave makes a transition may be made identical between a horizontal period within which a liquid crystal alternating signal changes and a horizontal period immediately succeeding the horizontal period. In this case, the sequence of selection periods during which high-order data and low-order data are selected respectively is made identical between the horizontal periods before and after the liquid crystal alternating signal changes. This makes it possible to retain the frequency components of the driving potential at frequencies that are not high.

Furthermore, according to the method of the embodiment of the present invention, the timing when a driving wave makes a transition is made identical between a horizontal period within which a liquid crystal alternating signal changes and a horizontal period immediately succeeding the horizontal period. This leads to a halved number of signal lines on which the liquid crystal driving waves make a transition simultaneously. Consequently, influence of motion of charges transmitted over a common scanning electrode can be alleviated.

An embodiment of the present invention will be detailed in conjunction with the drawings below. It is noted that the present invention is not limited to the embodiments described herein.

(Control System for the Whole Drive Unit)

Referring to FIG. 1, a description will be made of the configuration of a liquid crystal drive unit for achieving four-level gray-scale display according to the MLS method. A microprocessor unit (MPU) 10 transfers display data and control signals to a signal line driver 20 that has the ability to generate a liquid crystal driving system timing signal, and controls a display device (e.g., liquid crystal panel 40). The signal line driver 20 determines a liquid crystal potential according to the display data and control signals transferred from the MPU 10. An external oscillation circuit 60 for generating the liquid crystal driving system timing signal is connected to the signal line driver 20. Power is supplied from a power circuit 50 to the signal line driver 20 and a scanning line driver 30.

(Signal Line Driver)

Figure 2:
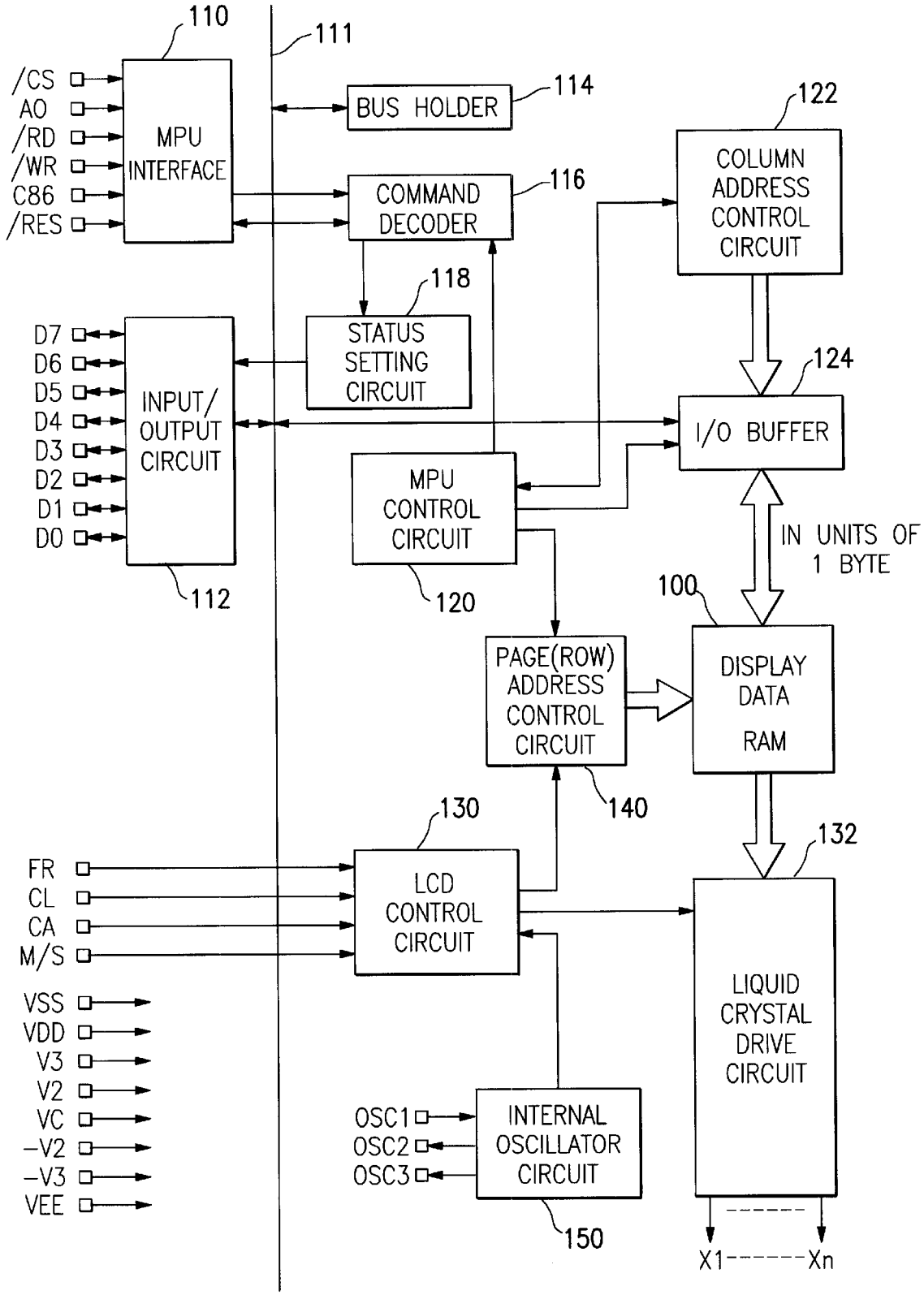
FIG. 2 is a block diagram showing the configuration of a signal line driver shown in FIG. 1.

Next, the signal line driver will be described with reference to FIG. 2.

The signal line driver includes a display data RAM 100, an MPU control circuit 120, and an LCD control circuit 130. The MPU control circuit 120 controls the operation of reading or writing display data in units of 1 byte from or in the display data RAM 100. The LCD control circuit 130 controls reading of display data rendering four lines from the display data RAM 100, and enables gray-scale display based on a four-line selection method belonging to the MLS method. Bus connection pins /CS, A0, /RD, /WR, C86 and /RES are connected on a bus line 111 inside the IC via an MPU interface 110. Bus connection pins D7 to D0 are also connected on the bus line 111 via an input/output circuit 112. Control data and display data to be input or output via the MPU interface 110 and input/output circuit 112 can be held in a bus holder 114 by way of the bus line 111. The control data is decoded by a command decoder 116, and used as a command signal to be sent to a status setting circuit 118 and MPU control circuit 120.

The MPU control circuit 120 controls a column address control circuit 122 and a RAM I/O buffer 124, and reads or writes display data from or in the RAM 100 in units of 1 byte.

The LCD control circuit 130 is connected to external pins RF, CL, and CA, and also to an internal oscillator circuit 150. The LCD control circuit 130 drives and controls the liquid crystal drive circuit 132, reads gray-scale display data rendering four lines from the RAM 100, and supplies a data signal used for MLS driving onto the signal lines in the liquid crystal display panel 10. A page (row) address control circuit 140 has a page (row) address decoder, and activates one word line in the RAM 100 according to a page address sent from one of the MPU control circuits 120 and LCD control circuits 130.

The pins will be described below.

D7 to D0: these pins are connected to a standard data bus, of which bit rate is 8 or 16 bits, in the MPU or a bidirectional data bus whose bit rate is 8 bits.

A0: this pin is connected to a least-significant bit line of an address bus in the MPU. When an input is 0, control data is passed through D7 to D0. When an input is 1, display data is passed through D7 to D0.

/RES: a reverse signal of a reset signal RES is input through this pin. When the input is low, initialization is performed.

/CS: a reverse signal of a chip selection signal CS is input through this pin.

/RD, /WR, C86: these pins are used differently between when a 80-series MPU is connected and when a 68-series MPU is connected. A signal for determining the timing of reading or writing is input through this pin.

CL: a display clock output pin through which a clock is input.

FR: a liquid crystal alternating signal output pin through which a liquid crystal alternating signal is output.

CA: a frame scan start signal output pin through which a frame scan start signal is output.

OSC1 to 3: through which the signal line driver actuates the internal oscillator circuit 150. In this case, as shown in FIG. 1, the external oscillation circuit 60 composed of a resistor R and a capacitor C is connected to the signal line driver. A clock whose frequency f equals to $1/(2.2\times C\times R)$ (Hz) is sent through the CL pin and oscillates.

(Liquid Crystal Drive Circuit)

The liquid crystal drive circuit will be detailed with reference to FIG. 3.

Figure 3:
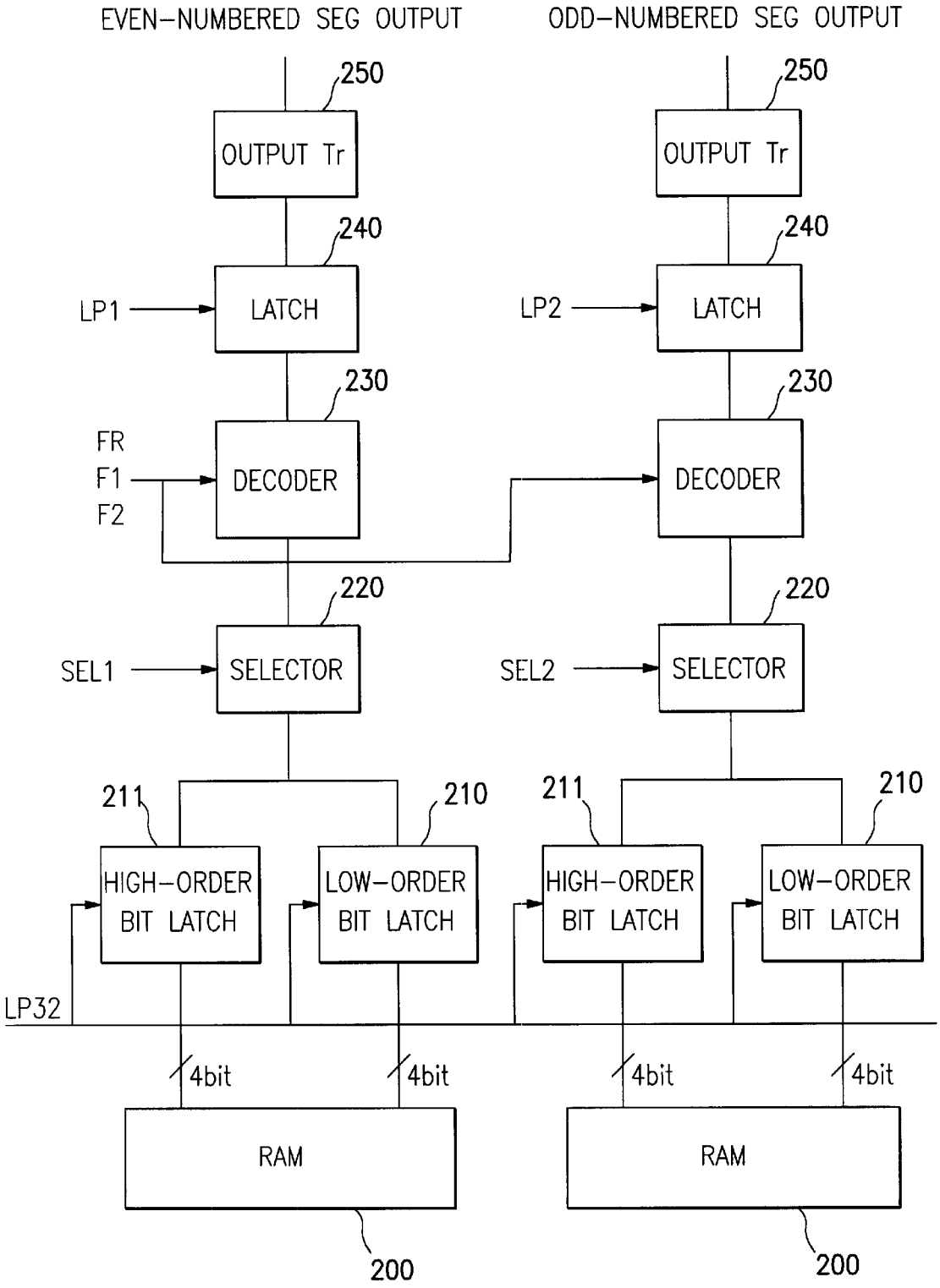
FIG. 3 is a block diagram showing the configuration of a liquid crystal drive circuit shown in FIG. 2.

FIG. 3 shows the configuration of the liquid crystal drive circuit included in the signal line driver. The liquid crystal drive circuit has half latches 210 and 211, a selector 220, a decoder 230, a full latch 240, and an output transistor 250. The half latches 210 and 211 hold gray-scale display data rendering four lines, which is read from the display RAM 200, with high-order data and low-order data separated from each other. The selector 220 selects either the high-order data or low-order data of the gray-scale display data rendering four lines. The decoder 230 performs the arithmetic operations for MLS on the display data selected by the selector 220. The full latch 240 holds data resulting from the arithmetic operations for MLS performed by the decoder 230. The output transistor 250 outputs a liquid crystal driving potential associated with the data resulting from the arithmetic operations for MLS. The timing of changing a driving potential (the sequence in which the high-order data and low-order data are selected within one horizontal period) is different between an odd output and an even output. Consequently, a timing signal LP 32, signals SEL1 and SEL2, and timing signals LP1 and LP2 are input to the half latches 210 and 211, the selector 220, and the latch 240 respectively at different time instants by means of the LCD control circuit 130 shown in FIG. 2. In this embodiment, the half latches 210 and 211 hold the high-order data and low-order data of the gray-scale display data rendering four lines and being read from the display data RAM 200. The selector 220 selects either of the latched data items. The latch 240 holds data output from the decoder 230 that performs the arithmetic operations for MLS on the display data selected by the selector 220.

Figure 4:
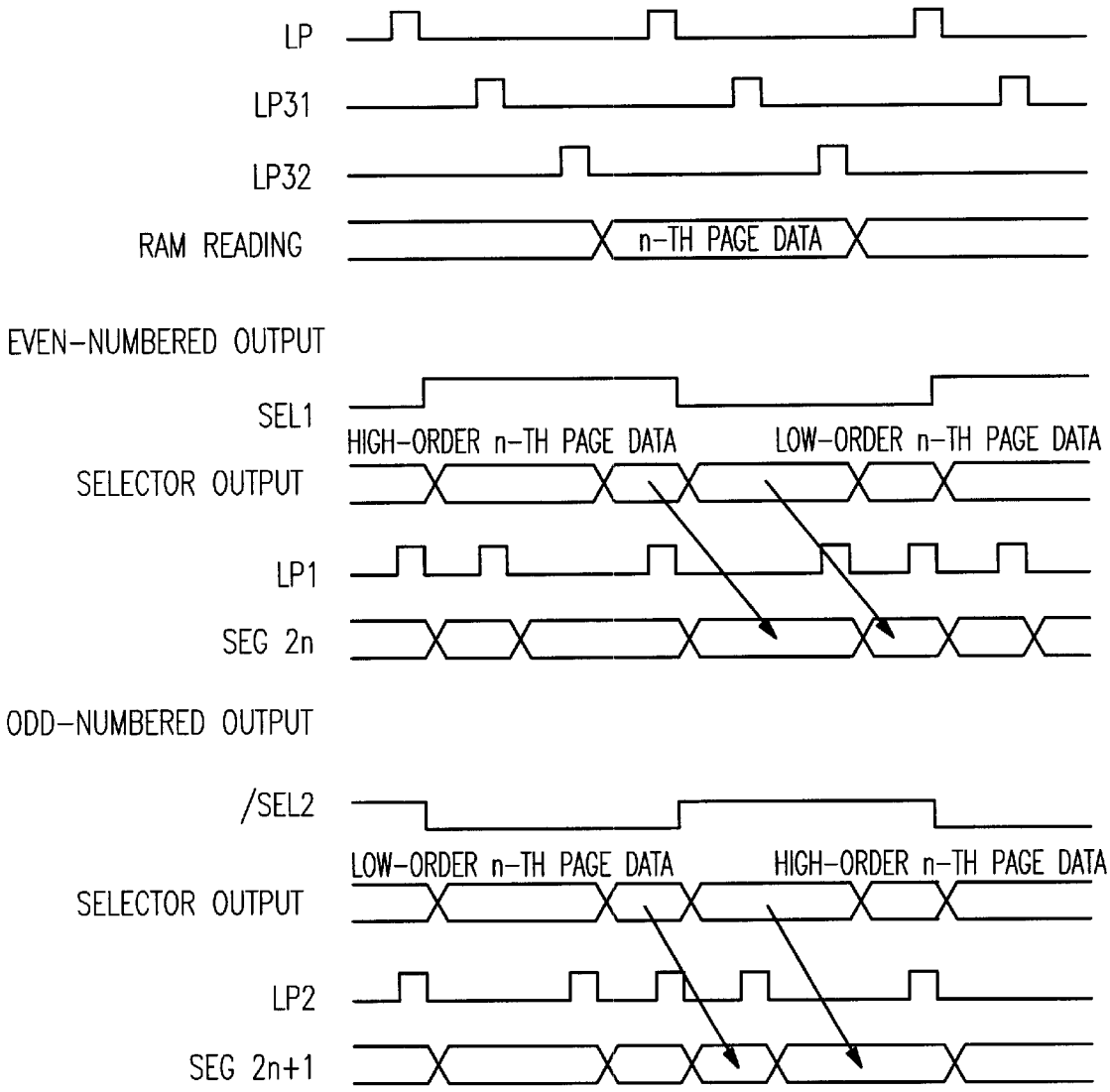
FIG. 4 is a timing chart for explaining the actions of the liquid crystal drive circuit shown in FIG. 3.

FIG. 4 is a timing chart concerning the liquid crystal drive circuit.

Word line data in the display RAM is set to that of an p-th page (p is a positive integer), and gray-scale display data rendering four lines in the p-th page is read from the display RAM according to the timing of a signal LP32. Thereafter, the display data read from the display RAM is latched as an even-numbered output or an odd-numbered output. As the even-numbered output or odd-numbered output, either the high-order display data or low-order display data is selected using a signal SEL or /SEL. The selector selects the high-order display data as a selector output when it inputs a high-level signal. The selector selects the low-order display data as the selector output when it inputs a low-level signal. Consequently, as the even-numbered output, the high-order display data of the p-th page is selected, and the low-order display data is then selected.

As the odd-numbered output, the low-order display data and high-order display data are selected in that order. The high-order and low-order display data of the p+1-th page are selected according to a sequence reverse to the sequence in which the corresponding data items of the p-th page are selected. As the even-numbered output, the low-order display data and high-order display data are selected in that order. As the odd-numbered output, the high-order display data and low-order display data are selected in that order. The arithmetic operations for MLS are performed on the display data selected by the MLS decoder according to the liquid crystal alternating signal FR and field identification signals F1 and F2. The results of the arithmetic operations performed on the even-numbered output are held in a latch according to the timing of a signal LP1. A liquid crystal driving potential is then output. The results of the arithmetic operations performed on the odd-numbered output are held in a latch according to the timing of a signal LP2, and a liquid crystal driving potential is then output.

(Four-level Gray-scale Display Performed According to the Pulse Width Modulation Method)

A description will be made of four-level gray-scale display to be performed according to the pulse width modulation method based on the MLS method.

For four-level gray-scale display, one pixel is, as shown in FIG. 5, represented with two-bit display data.

On a data bus D[0:7], pixel data is composed of a pair of bits (D0, D1), (D2, D3), (D4, D5), or (D6, D7). The data bits D0, D2, D4, and D6 (data items a11L, a12L, a13L, and a14L in FIG. 9) represent a weight determining a low gray-scale level. The bits D1, D3, D5, and D7 (data items a11H, a12H, a13H, and a14H in FIG. 9) represent a weight determining a high gray-scale level. Display is controlled on the assumption that one horizontal period is divided in the ratio of 1:2 (the short period is a period F and the long period is a period S). A liquid crystal driving potential determined by performing the arithmetic operations for MLS on the low-order display data items a11L to a14L is output during the period F. A liquid crystal driving potential determined by performing the arithmetic operations for MLS on the high-order display data items a11H to a14H is output during the period S. Thus, the arithmetic operations for MLS are performed on the high-order display data and low-order display data respectively within one horizontal period. A voltage of an effective value determined based on the high-order display data and a voltage of an effective value determined based on the low-order display data are summed up and applied to each liquid crystal pixel location, whereby gray-scale display is achieved.

FIG. 5 shows the driving waves determined based on the gray-scale display data listed in FIG. 9. FIG. 10 lists the results of the arithmetic operations for MLS performed on the display data listed in FIG. 9. FIG. 5 shows outputs SEG for rendering the first field which are provided when a liquid crystal alternating signal FR is low. Assuming that the sequence of selection periods is discussed in terms of an odd-numbered output, it becomes as follows: the period F precedes the period S within the first horizontal (1H) period; the period S precedes the period F within the second horizontal (2H) period; the period F precedes the period S within the third horizontal (3H) period; and the period S precedes the period F during the fourth horizontal (4H) period. In contrast, assuming that the sequence of selection periods is discussed in terms of an even-numbered output, it becomes as follows: the period S precedes the period F within the first horizontal period; the period F precedes the period S within the second horizontal period; the period S precedes the period F within the third horizontal period; and the period F precedes the period S within the fourth horizontal period. A driving wave SEGn expresses gray-scale level 0, a driving wave SEG4m+1 expresses gray-scale level 2, a driving wave SEG4m+3 expresses gray-scale level 1, and a driving wave SEG4m+4 expresses gray-scale level 3. As for the SEG4m+1 expressing gray-scale level 0, the arithmetic operations for MLS performed on both the high-order and low-order display data items result in a liquid crystal driving potential of V2. The SEG4m+1 represents the potential V2 during both the periods F and S. As for the SEG4m+4 expressing gray-scale level 3, the arithmetic operations for MLS performed on both the high-order and low-order display data items result in a liquid crystal driving wave of −V2. The SEG4m+4 represents the potential −V2 during both the periods F and S. As for the SEG4m+2 expressing gray-scale level 2, the arithmetic operations for MLS performed on the high-order display data thereof result in −V2, while those performed on the low-order display data result in V2. Consequently, the SEG4m+2 represents the liquid crystal driving potentials of −V2 and V2 in that order within the first horizontal (1H) period, V2 and −V2 in that order within the second horizontal (2H) period, and −V2 and V2 in that order within the third horizontal (3H) period. As for the SEG4m+3 expressing gray-scale level 1, the arithmetic operations for MLS performed on the high-order display data result in V2, while those performed on the low-order display data result in −V2. Consequently, the SEG4m+3 represents the liquid crystal driving potentials of −V2 and V2 in that order within the first horizontal (1H) period, V2 and −V2 in that order within the second horizontal (2H) period, and −V2 and V2 in that order within the third horizontal (3H) period.

In the related art shown in FIG. 6, the sequence of selection periods in which the period S and the period F appear is always the same in each horizontal period. In contrast, in one embodiment of the present invention shown in FIG. 5, the sequence of selection periods in which the period S and the period F appear is alternately reversed in each horizontal period. As a result, the number of changes in a signal potential can be reduced, and the number of frequency components of display data is reduced.

Figure 8:
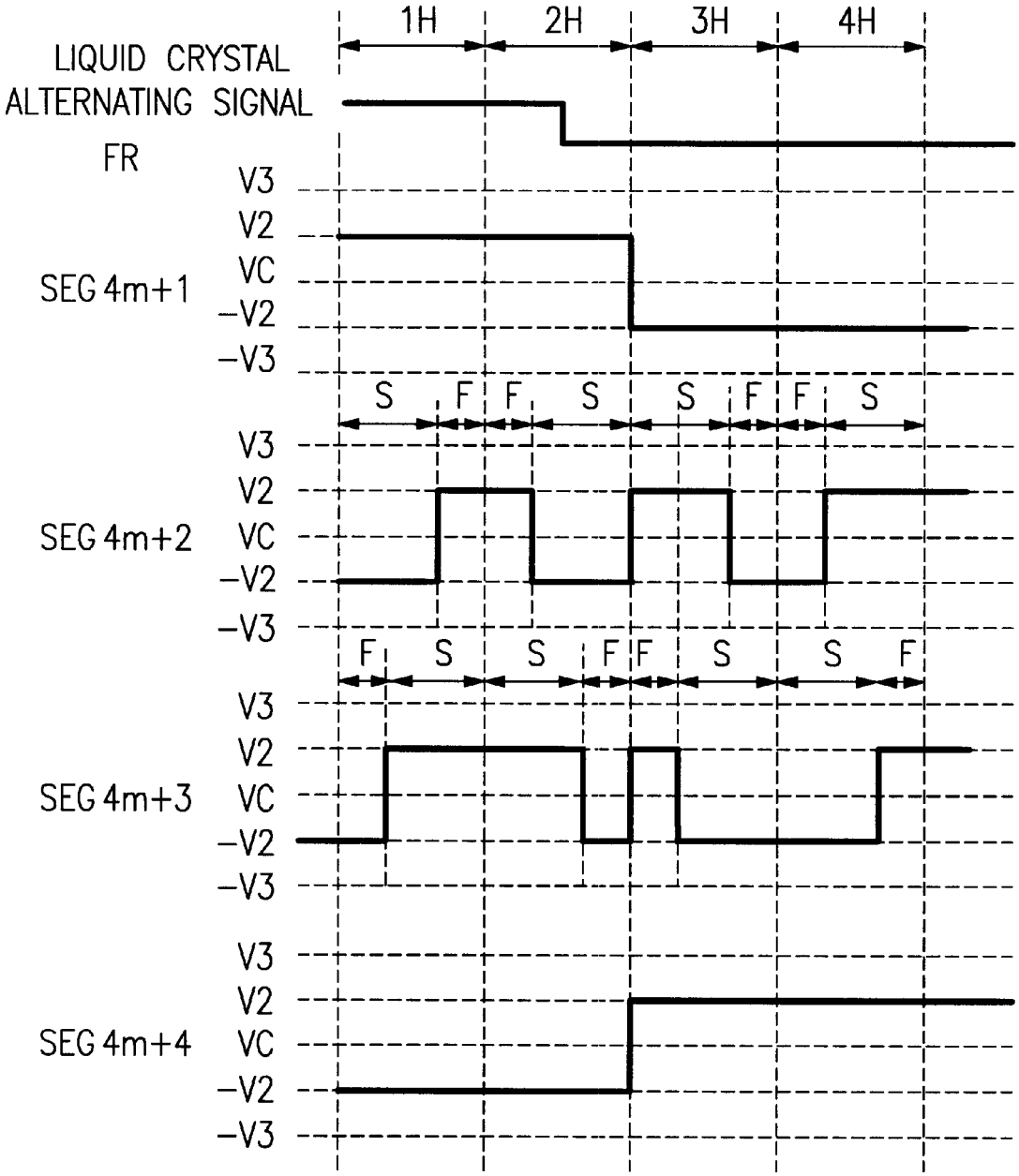
FIG. 8 shows the driving waves produced by the signal line driver according to the PWM method and the multi-line selection method related to a preferred embodiment of the present invention.

FIG. 8 shows drive waves when a liquid crystal alternating signal FR changes according to the driving rule shown in FIG. 5. When the signal FR is changed within the second horizontal (2H) period preceding the third horizontal (3H) period, the odd-numbered output (SEG4m+3) assumes a sequence of selection periods in which the period S precedes the period F within the 2H period; and the period F precedes the period S in the 3H period. The even-numbered output (SEG4m+2) assumes a sequence of selection periods in which the period F precedes the period S within the 2H period; and the period S precedes the period F within the 3H period. The selection potential represented by the SEG4m+1 changes from V2 to −V2, and the selection potential represented by the SEG4m+4 changes from −V2 to V2, at a shifting point at which the 2H period shifts to the 3H period. A selection potential represented by the SEG4m+2 changes from V2 to −V2 within the 2H period, further changes from −V2 to V2 at a shifting point at which the 2H period shifts to the 3H period, and changes from V2 to −V2 within the 3H period. A selection potential represented by the SEG4m+3 changes from V2 to −V2 within the 2H period, further changes from −V2 to V2 at a shifting point at which the 2H period shifts to the 3H period, and changes from V2 to −V2 within the 3H period.

It is understood from the above that if the rule shown in FIG. 5 is applied without any modification, the number of changes in a signal potential is increased in one horizontal period in which a liquid crystal alternating signal changes and an immediately succeeding horizontal period, compared to the normal situation. In this connection, a driving method in accordance with a preferred embodiment of the present invention is shown in FIG. 7.

Figure 7:
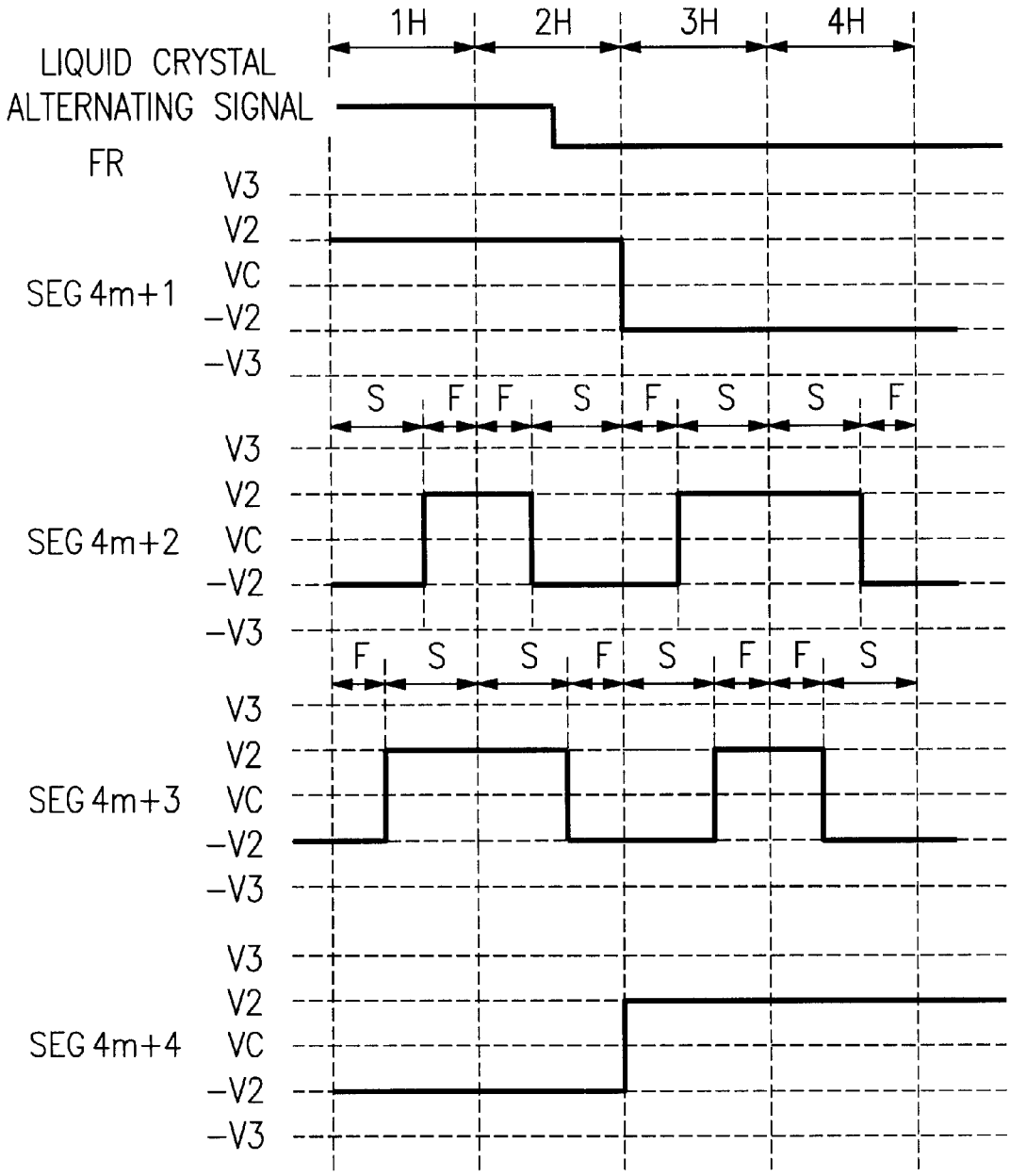
FIG. 7 shows the driving waves produced by the signal line driver according to the PWM method and the multi-line selection method related to a preferred embodiment of the present invention.

FIG. 7 shows driving waves of the preferred embodiment to be detected when a liquid crystal alternating signal FR changes. The signal RF is made a high-to-low transition within the second horizontal (2H) period preceding the third horizontal (3H) period. As an odd-numbered output, data items associated with the periods F and S respectively are provided in that order within the second horizontal (2H) period, and the data items associated with the periods F and S respectively are provided in that order within the third (3H) period. A selection potential represented by the SEG4m+1 changes from V2 to −V2 at the time of shifting from the 2H period to the 3H period. A selection potential represented by the SEG4m+3 changes from −V2 to V2 at the same time of shifting. A selection potential represented by the SEG4m+2 changes from V2 to −V2 within the 2H period and from −V2 to V2 within the 3H period. A selection potential represented by the SEG4m+3 changes from V2 to −V2 within the 2H period and from −V2 to V2 within the 3H period. The sequence of selection periods is made identical between the 2H period when the liquid crystal alternating signal FR changes and 3H period after the liquid crystal alternating signal FR changes. Thus, the low-order display data and high-order display data are selected in that order according to the SEG4m+2, and the high-order display data and low-order display data are selected in that order according to the SEG4m+3. Namely, the sequence of selection periods during which display data items are selected is made identical between horizontal periods before and after the FR changes.

Compared with the embodiment shown in FIG. 8, the number of frequency components of a driving wave used to express the same gray-scale level is smaller.

Moreover, according to this embodiment, one horizontal period is divided in the ratio of 1:2. One horizontal period may not be trisected in order to determine transition time points. One horizontal period may be divided into a larger number of sub-periods, wherein the transition time points can be adjusted. Consequently, gray-scale display can be realized with high display definition according to the optical characteristic of a liquid crystal panel employed. For this purpose, the frequency of an internal oscillating signal is raised to a multiple by a numeral corresponding to the number of sub-periods. A frequency divider or the like is used to divide the resultant frequency.

The embodiments of the present invention have been described above. However, it is noted that the present invention is not limited to the embodiment described above. For example, a liquid crystal display device having the liquid crystal drive unit of the present invention, and an electronic equipment having the liquid crystal display device are included in the scope of the present invention.

INDUSTRIAL APPLICABILITY

As described above, a liquid crystal drive unit has a scanning electrode driver and a signal electrode driver and controls display according to the MLS method. The sequence of selection periods during which high-order display data and low-order display data are selected respectively is alternated for each horizontal period. The number of transitions made by a liquid crystal driving wave becomes smaller than the number of transitions that was thought to be made conventionally. The difference in the number of frequency components between a driving wave that is used to express gray-scale level 0 (solid white) or gray-scale level 3 (solid black) and a driving wave used to express gray-scale level 1 or 2 (intermediate gray-scale level) becomes smaller. Since the timing when a liquid crystal driving wave makes a transition is differentiated between an even-numbered output of a signal line driver and an odd-numbered output thereof, the number of signal lines on which the liquid crystal driving waves make a transition simultaneously is halved. This leads to reduced influence of motion of charges transmitted over a common scanning electrode. The sequence of selection periods during which high-order data and low-order data are selected respectively is made identical between horizontal periods before and after a liquid crystal alternating signal FR changes. This makes it possible to retain the frequency components of a driving wave at frequencies that are not high. Consequently, when the MLS method is adopted, low power consumption is realized, and crosstalk or the like that is a drawback of gray-scale display based on the pulse width modulation method can be overcome, in other words, display definition can be improved. Eventually, gray-scale display can be achieved successfully without deterioration in contrast and occurrence of flickers or crosstalk.

Moreover, the weighted temporal widths of selection periods within one horizontal period may be varied. In this case, shades of intermediate gray-scale levels can be adjusted easily. Consequently, shades can be adjusted in line with the characteristics of an employed liquid crystal panel.

What is claimed is:

1. A liquid crystal drive unit comprising a scanning electrode driver, a signal electrode driver, a frame memory used to store display data and incorporated in said signal electrode driver, and a gray-scale display unit incorporated therein and controlling display according to the multi-line selection method, wherein:

said gray-scale display unit performs gray-scale display using n-bit data, where n denotes a natural number, one horizontal period is divided into n selection periods whose temporal widths are weighted according to said display data; and said signal electrode driver includes a controller for varying the sequence in which said plurality of differently weighted selection periods is selected for each horizontal period.

2. A liquid crystal drive unit according to claim 1, wherein said gray-scale display is achieved based on bit data consisting of one to four bits.

3. A liquid crystal drive unit according to claim 1, wherein the sequence in which said plurality of differently weighted selection periods is selected is differentiated between a first liquid crystal driving electrode and a second liquid crystal driving electrode which are mutually adjoining in said signal electrode driver.

4. A liquid crystal drive unit according to claim 1, wherein the sequence in which said plurality of differently weighted selection periods is selected is made identical between one horizontal period within which a liquid crystal alternating signal changes and another horizontal period immediately succeeding the one horizontal period.

5. A liquid crystal drive unit according to claim 1, wherein the temporal widths of said weighted selection periods are variable.

6. A liquid crystal driving method for displaying display data according to the multi-line selection method in which assuming that gray-scale display is achieved based on n-bit data where n denotes a natural number, one horizontal period is divided into n selection periods whose temporal widths are weighted according to said display data, wherein:

the sequence in which said plurality of differently weighted selection periods is selected is varied for each horizontal period.

7. A liquid crystal driving method according to claim 6, wherein the timing when a liquid crystal driving wave makes a transition is changed between successive outputs of a signal electrode driver.

8. A liquid crystal driving method according to claim 6, wherein the timing when a liquid crystal driving wave makes a transition is not fixed but varied for each horizontal period.

9. A liquid crystal driving method according to claim 6, wherein a liquid crystal driving wave is caused to make a transition when a horizontal period within which a liquid crystal alternating signal changes shifts to an immediately succeeding horizontal period.

10. A liquid crystal driving method according to claim 6, wherein the timing when a liquid crystal driving wave makes a transition is made identical between a horizontal period within which a liquid crystal alternating signal changes and a horizontal period immediately succeeding the horizontal period.

11. A liquid crystal drive unit adapted to control display according to a multi-line selection method, comprising:

a scanning electrode driver;

a signal electrode driver comprising a frame memory used to store display data, a controller, and a gray-scale display unit adapted to perform gray-scale display using n-bit data, wherein n denotes a natural number;

wherein one horizontal period is divided into n selection periods each having a temporal width, wherein the temporal widths of each of n selection periods are weighted according to said display data to provide a plurality of differently weighted selection periods, and wherein the controller varies a sequence according to which said plurality of differently weighted selection periods are selected within each horizontal period.

12. A liquid crystal drive unit according to claim 11, wherein n denotes a natural number between one and four such that the gray-scale display unit performs the gray-scale display using 1-bit data, 2-bit data, 3-bit data or 4-bit data.

13. A liquid crystal drive unit according to claim 11, wherein the signal electrode driver further comprises:

a first liquid crystal driving electrode; and a second liquid crystal driving electrode, wherein the first liquid crystal driving electrode and the second liquid crystal driving electrode are mutually adjoining in said signal electrode driver, and wherein the sequence in which said plurality of differently weighted selection periods are selected is differentiated between the first liquid crystal driving electrode and the second liquid crystal driving electrode.

14. A liquid crystal drive unit according to claim 11, wherein the sequence in which said plurality of differently weighted selection periods is made identical between A and B, wherein A is a horizontal period before a liquid crystal alternating signal changes, and wherein B is another horizontal period immediately after the liquid crystal alternating signal changes.

15. A liquid crystal drive unit according to claim 11, wherein the temporal widths of said weighted selection periods with the one horizontal period are arbitrarily variable.

16. A liquid crystal driving method for displaying display data according to the multi-line selection method in which gray-scale display is achieved based on n-bit data where n denotes a natural number, wherein one horizontal period is divided into n selection periods each having a temporal width, comprising:

varying a sequence according to which a plurality of differently weighted selection periods are selected for each horizontal period, wherein the temporal widths are weighted according to said display data to provide the plurality of differently weighted selection periods.

17. A liquid crystal driving method according to claim 16, further comprising:

changing the timing when a liquid crystal driving wave transitions between successive outputs of a signal electrode driver.

18. A liquid crystal driving method according to claim 17, further comprising:

varying the timing for each horizontal period when a liquid crystal driving wave transitions such that the timing for each horizontal period is not fixed for each horizontal period.

19. A liquid crystal driving method according to claim 17, further comprising:

causing a liquid crystal driving wave to transition when a horizontal period, within which a liquid crystal alternating signal changes, shifts to an immediately succeeding horizontal period.

20. A liquid crystal driving method according to claim 17, further comprising:

making the timing identical between A and B when a liquid crystal driving wave transitions, wherein A is a horizontal period within which a liquid crystal alternating signal changes, and wherein B is a horizontal period immediately succeeding the horizontal period.

21. A liquid crystal display device, comprising:

a liquid crystal drive unit adapted to control display according to a multi-line selection method, the liquid crystal drive unit comprising:

a scanning electrode driver;

a signal electrode driver comprising a frame memory used to store display data, a controller, and a gray-scale display unit adapted to perform gray-scale display using n-bit data, wherein n denotes a natural number;

wherein one horizontal period is divided into n selection periods each having a temporal width, wherein the temporal widths of each of n selection periods are weighted according to said display data to provide a plurality of differently weighted selection periods, and wherein the controller varies a sequence according to which said plurality of differently weighted selection periods are selected within each horizontal period.

22. A liquid crystal drive unit according to claim 21, wherein n denotes a natural number between one and four such that the gray-scale display unit performs the gray-scale display using 1-bit data, 2-bit data, 3-bit data or 4-bit data.

23. A liquid crystal drive unit according to claim 21, wherein the signal electrode driver further comprises:

a first liquid crystal driving electrode; and a second liquid crystal driving electrode, wherein the first liquid crystal driving electrode and the second liquid crystal driving electrode are mutually adjoining in said signal electrode driver, and wherein the sequence in which said plurality of differently weighted selection periods are selected is differentiated between the first liquid crystal driving electrode and the second liquid crystal driving electrode.

24. A liquid crystal drive unit according to claim 21, wherein the sequence in which said plurality of differently weighted selection periods is made identical between A and B, wherein A is a horizontal period before a liquid crystal alternating signal changes, and wherein B is another horizontal period immediately after the liquid crystal alternating signal changes.

25. A liquid crystal drive unit according to claim 21, wherein the temporal widths of said weighted selection periods with the one horizontal period are arbitrarily variable.

26. An electronic apparatus, comprising:

a liquid crystal display device comprising a liquid crystal drive unit adapted to control display according to a multi-line selection method, wherein the liquid crystal drive unit, comprises:

a scanning electrode driver;

a signal electrode driver comprising a frame memory used to store display data, a controller, and a gray-scale display unit adapted to perform gray-scale display using n-bit data, wherein n denotes a natural number;

wherein one horizontal period is divided into n selection periods each having a temporal width, wherein the temporal widths of each of n selection periods are weighted according to said display data to provide a plurality of differently weighted selection periods, and wherein the controller varies a sequence according to which said plurality of differently weighted selection periods are selected within each horizontal period.

27. A liquid crystal drive unit according to claim 26, wherein n denotes a natural number between one and four such that the gray-scale display unit performs the gray-scale display using 1-bit data, 2-bit data, 3-bit data or 4-bit data.

28. A liquid crystal drive unit according to claim 27, wherein the signal electrode driver further comprises:

a first liquid crystal driving electrode; and a second liquid crystal driving electrode, wherein the first liquid crystal driving electrode and the second liquid crystal driving electrode are mutually adjoining in said signal electrode driver, and wherein the sequence in which said plurality of differently weighted selection periods are selected is differentiated between the first liquid crystal driving electrode and the second liquid crystal driving electrode.

29. A liquid crystal drive unit according to claim 28, wherein the sequence in which said plurality of differently weighted selection periods is made identical between A and B, wherein A is a horizontal period before a liquid crystal alternating signal changes, and wherein B is another horizontal period immediately after the liquid crystal alternating signal changes.

30. A liquid crystal drive unit according to claim 29, wherein the temporal widths of said weighted selection periods with the one horizontal period are arbitrarily variable.

* * * * *